US006168558B1

(12) United States Patent
Vinberg

(10) Patent No.: US 6,168,558 B1
(45) Date of Patent: Jan. 2, 2001

(54) ROLL OF BAGS AND METHOD AND DEVICE FOR PRODUCING THE SAME

(75) Inventor: Kenneth Vinberg, Malmö (SE)

(73) Assignee: FAS Converting Machinery AB, Ystad (SE)

( * ) Notice: Under 35 U.S.C. 154(b), the term of this patent shall be extended for 0 days.

(21) Appl. No.: 09/142,571

(22) PCT Filed: Mar. 14, 1997

(86) PCT No.: PCT/SE97/00436

§ 371 Date: Sep. 15, 1998

§ 102(e) Date: Sep. 15, 1998

(87) PCT Pub. No.: WO97/33744

PCT Pub. Date: Sep. 18, 1997

(30) Foreign Application Priority Data

Mar. 15, 1996 (SE) ..... 9601010

(51) Int. Cl.[7] ..... B31B 1/64; B65B 63/04; B65H 39/14

(52) U.S. Cl. ..... 493/196; 493/194; 493/200; 493/208; 493/231; 493/341; 493/360; 493/403; 493/446; 53/118; 242/258

(58) Field of Search ..... 493/196, 194, 493/197, 199, 200, 202, 208, 231, 341, 446, 455, 178, 360, 359, 403, 434, 442; 53/118, 119; 242/528

(56) References Cited

U.S. PATENT DOCUMENTS

| | | | | |
|---|---|---|---|---|
| 3,791,267 | * | 2/1974 | Brooks | 493/194 |
| 3,978,191 | * | 8/1976 | Allen et al. | 493/442 |
| 4,041,849 | * | 8/1977 | Tsukasaki | 493/442 |
| 4,818,328 | * | 4/1989 | Hara | 53/118 |
| 4,892,512 | * | 1/1990 | Branson | 493/194 |
| 5,205,808 | * | 4/1993 | Gebhardt | 493/194 |
| 5,254,071 | * | 10/1993 | Laroche | 493/96 |
| 5,619,840 | * | 4/1997 | Nyman et al. | 54/430 |
| 5,827,162 | * | 10/1998 | Rubin et al. | 493/178 |

* cited by examiner

*Primary Examiner*—Brian L. Johnson
*Assistant Examiner*—Matthew Luby
(74) *Attorney, Agent, or Firm*—Brooks & Kushman P.C.

(57) ABSTRACT

Method and device for producing rolls (17) of bags. At least one longitudinal side edge (15, 16) of a line of overlapping bags (17) is folded towards the centre axis of said line of bags. The line is then winded to rolls (17).

23 Claims, 4 Drawing Sheets

FIG. 4
SECTION A-A
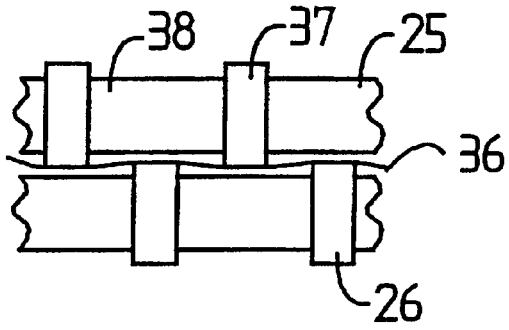
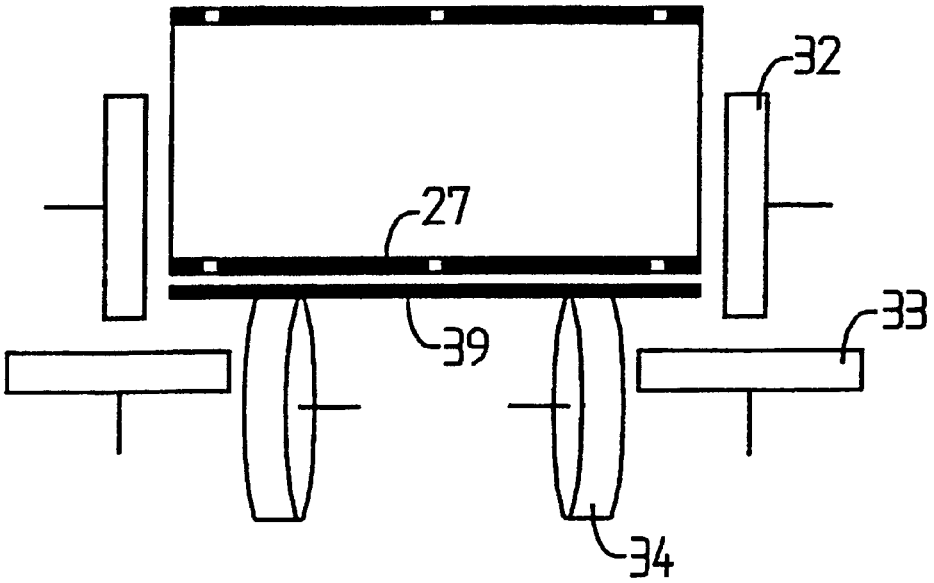
Fig. 5

ROLL OF BAGS AND METHOD AND DEVICE FOR PRODUCING THE SAME

TECHNICAL FIELD

The invention relates to a method and a device for producing plastic bags from a flattened flexible hose. The invention also relates to a roll of plastic bags.

PRIOR ART

It is common practice to produce plastic bags from flexible plastic hoses. The hose is flattened and formed into bags that are connected top to bottom by a perforation. Each bag normally extends over the complete width of the hose. A line of perforated but connected bag are then normally winded to form a roll of bags, and the roll is then disposed in a paper box or dispenser.

When a bag is to be removed from the roll and used it is necessary to locate the position of the perforated section and then tear off the bag. Different types of boxes and dispensers have been suggested but many consumers still find it difficult or troublesome to tear of the bag in an appropriate way. In prior art there are also rolls off plastic bags that are loosely collected in an overlapping position. However, rolls of this structure are less stable than rolls of bags that are connected by perforated sections.

SUMMARY OF THE INVENTION

An object of the invention is to improve the production of bags, preferably plastic bags. According to an embodiment of the invention it is possible to produce a roll of bags from which bags can be withdrawn in a simplified way.

Further advantages and features of the invention are shown in the description below and in the accompanying drawings and dependent claims.

BRIEF DESCRIPTION OF THE DRAWINGS

The invention will now be described in more detail with reference to embodiments of the invention shown in the drawings, in which FIG. 4 is a cut out sectional view from A—A in FIG. 2, FIG. 5 is a sectional view from B—B in FIG. 3.

DETAILED DESCRIPTION

Figure 1:
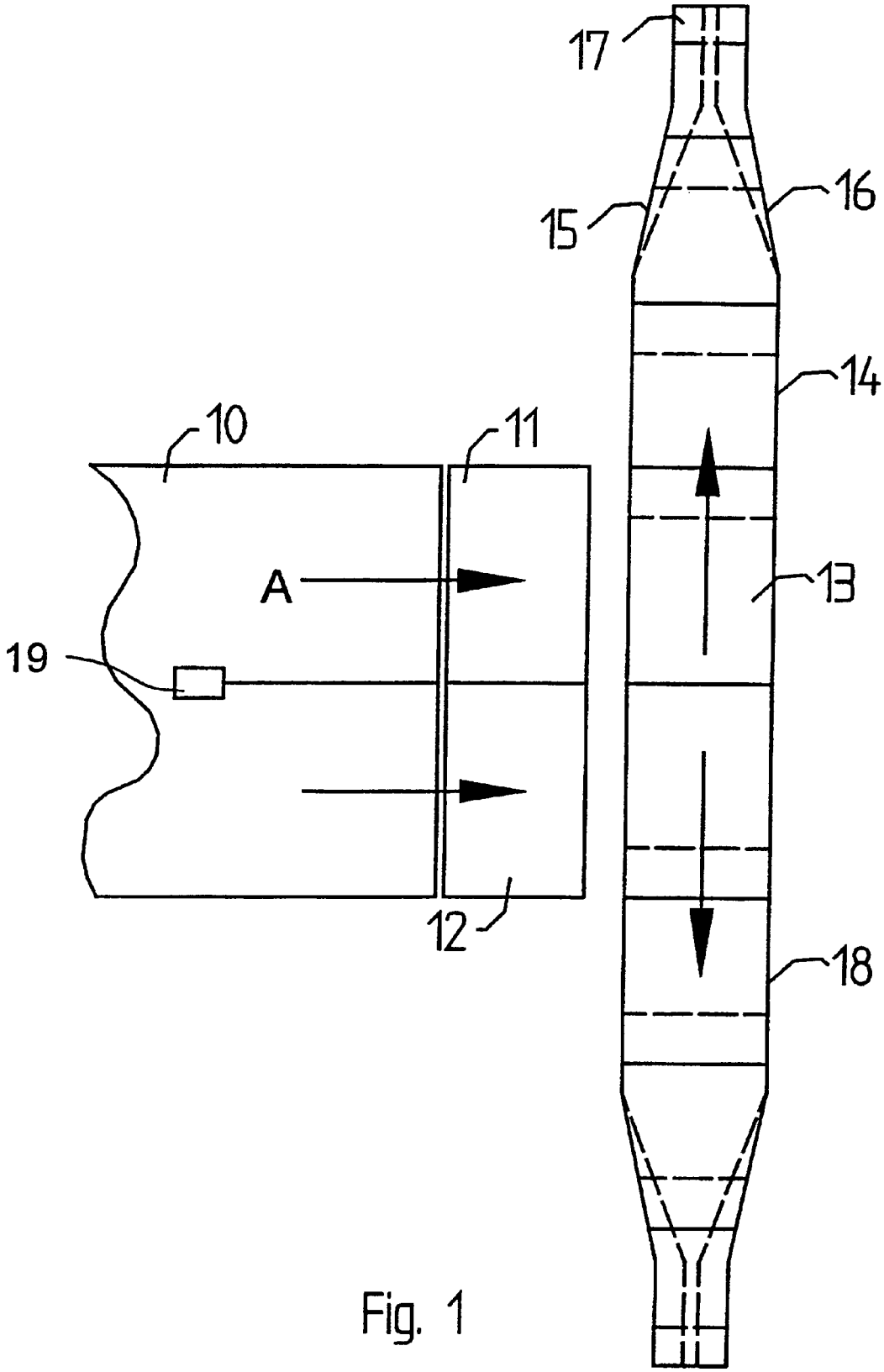
FIG. 1 is a general plan view of a device for producing bag according to one embodiment of the invention.

In FIG. 1 a continuous flattened flexible hose 10 is fed in the direction of arrow A. The hose is cut into two longitudinally extending sections by a cutting means 19. Both sections are then cut of from the continuous hose into elements 11, 12 by a heating means 23, see FIG. 2. Each element 11, 12 forms a bag when the cut of side edges thereof are sealed by the heating means 23. The heating means cuts and seals transversely across the hose. Opposite side edges of the elements 11, 12 form the openings of the bags.

Each of the bags or elements 11, 12 is supplied to a line 14, 18 on a conveyer fed in the transverse direction of the feeding direction of the hose 10. A cut of bag 11 is disposed on top of a bag 13 already disposed in the line 14.

Figure 3:
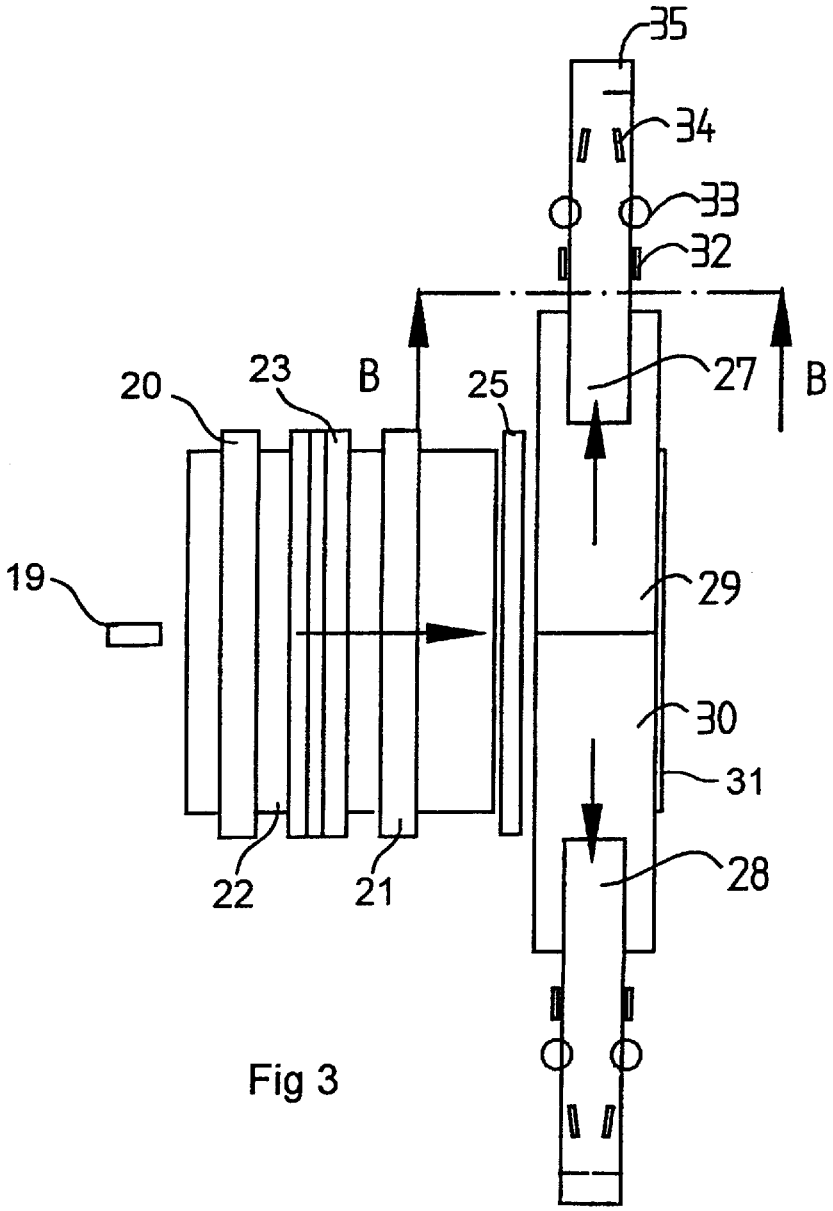
FIG. 3 is a more detailed plan view of the embodiment shown in FIG. 1.

Side edges 15, 16 of the overlapping bags are folded towards the centre of the line 14 by folding means, see FIG. 3 and FIG. 5, respectively. Rolls 17 of bags only are then formed from the line 14 and disposed automatically in boxes.

Figure 2:
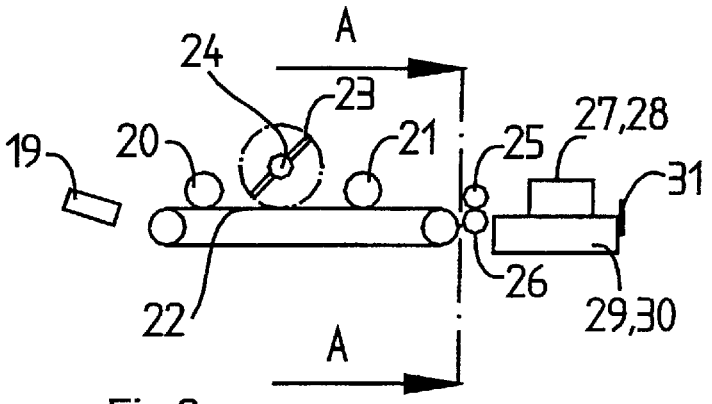
FIG. 2 is a side elevation view of the embodiment shown in FIG. 1.

As shown in FIG. 2 the continuous flattened flexible hose 10 is fed between a first conveyer 22 and a first and second clamp rollers 20, 21, respectively. The cutting means 19 comprises in a preferred embodiment a razor blade. The heating means 23 is provided between first and second clamp rollers 20, 21. In one embodiment the heating means 23 is provided on a rotating axis 24 and comprises two opposite radially extending heating plates. The axis extends in a direction transverse to the feeding direction of the hose. The rotation of the axis 24 is controlled by a central unit (not shown) in such a way that the circumferential speed of the heating means 23 corresponds to the feeding speed of the hose 23. The heating means 23 will then accompany the hose during a predetermined period of time. During said predetermined period of time the heating means 23 will cut the hose 10 into sections and at the same time seal side edges of said sections to form the bags. In the embodiment shown two bags are produced in each cycle. In one embodiment the heating plate will engage the hose sections for cutting and sealing. Also other combined cutting and sealing means, such as radiating means, for instance laser, can be used in other applications.

The cut of bags having opposed open ends and sealed side edges are fed from the first conveyer 22 to the lines 14, 18 by, respectively, by driving shafts 25, 26 which are disposed at an adjustable distance from the clamping roller 21. Preferably, the driving shafts 25, 26 rotate at a speed higher than the speed of the first conveyer 22. In this way the bags leaving the first conveyer will be accelerated and ride on an airflow towards a fixed stop 31. The airflow can be produced by a separate suction nozzle or by the fixed stop 31 comprising or forming such a nozzle.

The lines 14, 18 comprise second and third conveyers 29, 30, respectively, the upper side of said conveyers positioned just below the outfeed level of the driving shafts 25, 26. The fixed stop 31 at the far end of the conveyers 29, 30 as seen from the driving shafts 25, 26 ensures that the bags enter the conveyers 29, 30 properly.

Second and third conveyers 29, 30 are driven in opposite directions from the extended centre line of the first conveyer 22 at such a speed that a bag leaving the driving shafts 25, 26 will be disposed over and partly overlapping a bag previously taken action to. In a preferred embodiment second and third conveyers 29, 30 are suction conveyers. The lines 14, 18 continue after second and third conveyers 29, 30 with first and second suction conveyers 27, 28, respectively, arranged above second and third conveyers 29, 30. A suction conveyer can be a perforated conveyor belt pressurised to a lower pressure on one side.

The bags are fed by second and third conveyers 29, 30 and then pulled therefrom and lifted by first and second suction conveyers 27, 28. As can be seen from FIG. 3 the width of first and second suction conveyers 27, 28 is lower than the width of second and third conveyers 29, 30, and longitudinal side edges of the bags fed by first and second suction conveyers 27, 28 will be suspended therefrom over a plate 39 (see FIG. 5).

Said side edges of the bags will be folded down by first set of rollers 32, towards the centre of line 14 by second set of rollers 33 and pressed towards the underside of the plate 39 by third set of rollers 34. The bags then are rolled into rolls guided by clamp rollers 35 engaging the underside of first and second suction conveyers 27, 28. The function of the set of rollers is described more in detail below with reference to FIG. 5.

FIG. 4 shows a preferred embodiment used for feeding bags from the first conveyer 22 to second and third conveyers 29, 30. During this passage bags 36 are preferably made "stiffer" to facilitate the transfer. First and second driving shafts 25, 26 are formed with first sections 37 and second sections 38. The diameter of said second sections 38 is smaller than the diameter of said first sections 37. As a result the bags will be waved to get a higher flexural rigidity in a direction perpendicular to the feeding direction. Preferably the centre distances of the driving shafts 25, 26 can be adjusted. Another method of facilitating the transfer of bags is to provide the bags with a an electric charge to force the bags to repel each other. Such a method is appropriate when thin bags are processed.

FIG. 5 shows the folding procedure of the bags. The width of the plate 39 determines the width of the folded line 14. The first set of rollers 32 will ensure that side edges of the bags in the line 14 are folded correctly in a downward direction. Then the second set of rollers 33 will fold the bags towards the centre of line 14 below the plate 39. Finally, the third set of rollers 34 will press said side edges towards the underside of the plate 39. Preferably all sets of rollers are adjustable and rotated by a speed higher than the feeding speed of the line 14, so as to bring forward projecting flaps or ends of the bags.

Preferably the velocity of each of the conveyers and suction conveyers is individually adjustable as well as the time period between the cutting and sealing process of the heating means 23. As a result differently sized bags can be produced. The width of the plate 39 is adjustable or exchangeable.

Figure 6:
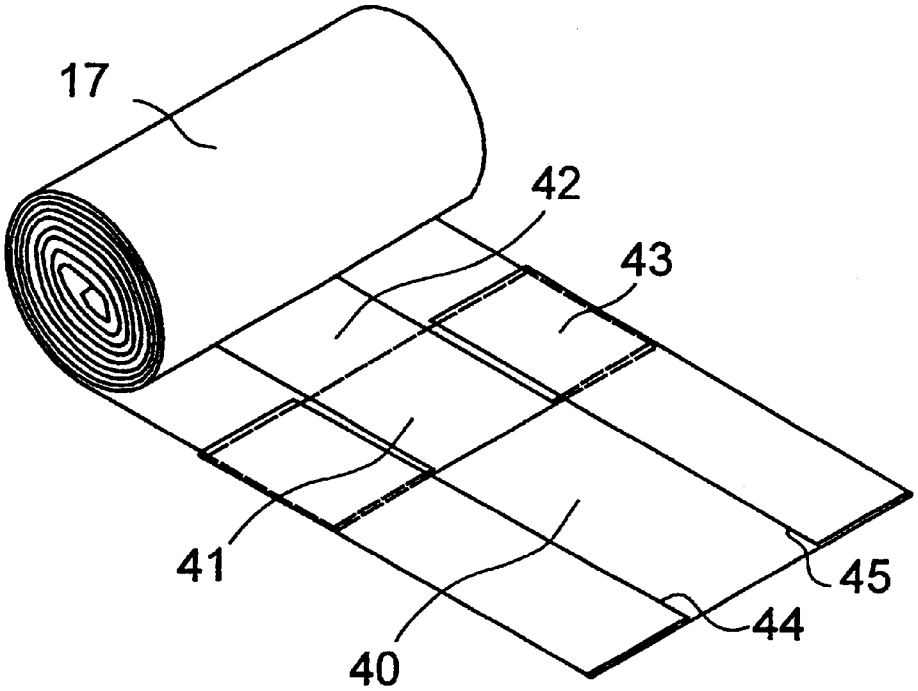
FIG. 6 is a schematic perspective view of a roll of bags produced according to the invention.

FIG. 6 shows a roll 17 comprising a line 42 of bags. A first outer bag 40 is completely rolled out of the roll 17 while a second inner bag 41 only partly is rolled out. Said first bag 40 overlaps said second bag 41 in an overlapping section 43. The first outer bag 40 is disposed under the second bag 41 and covers the bottom surface of the second bag 41. Furthermore, side edges 44, 45 of the first bag 40 are folded together with corresponding side edges of the second bag 41 towards a centre axis running in the longitudinal direction of the line 42 of bags. In this way the first bag 40 partly encloses the second bag 41. A central section adjacent to the centre axis lacks in the shown embodiment a folded part.

In some applications it is appropriate to fold only one side edge 44 of the first bag over the corresponding side edge of the second bag 41. The extension of the folded section varies to a large extent depending on the application and the type of material used. Bags having a mutually higher friction should require a more narrow folded section than bag having a lower friction. In the latter case it may even be appropriate to fold side edges of the first bag right up to the centre axis. It is also possible to fold the side edges even further to make the folded sections overlap.

Figure 7:
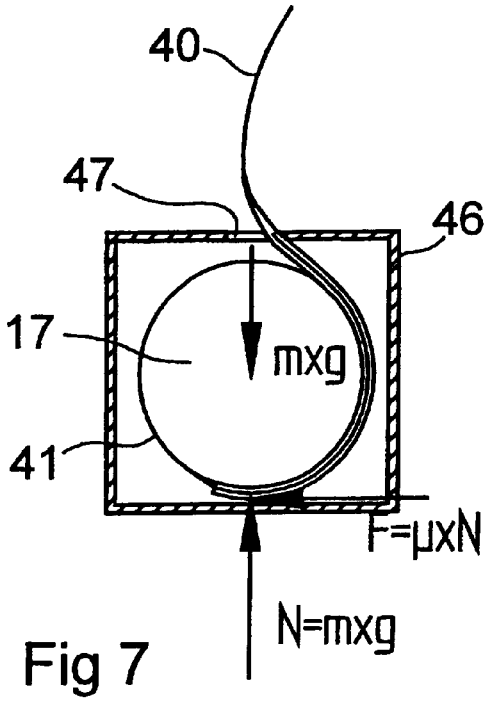
FIG. 7 shows forces exerted on a roll of bags in a box.

In FIG. 7 the forces acting on a roll 17 of bags 40, 41 disposed in a box 46 are shown. An outer bag 40 is shown just before releasing the second bag 41. Since the outer bag 40 encloses the subsequent bag 41 no flaps extend from the line or roll of bags and prevents the pull out of bags. Two surfaces of friction doubles the friction forces to $2 \cdot \mu \cdot m \cdot g$, $\mu$ being the friction coefficient between surfaces of plastic materials. To make the roll rotate in the box 46 three surfaces are operating and generate a total friction force of $3 \cdot \mu \cdot m \cdot g$.

When the outer bag 40 no longer encloses the second bag 41 there is no longer a normal force and consequently no friction. The pulled out bag is then released from the subsequent bag, and there is a braking force of $\mu \cdot m \cdot g$ acting on the roll. Here p can be the coefficient of friction between plastic surfaces or between a plastic surface and the surface of the box. The latter friction should be lower than the first so as to avoid that bags are rolled out within the bag. The pull out of bags will also be facilitated. A further advantage is that it is not necessary to use a bobbin which will facilitate the automatic winding of rolls.

The force required to pull out a bag is determined by the weight of the roll and therefore the size of the rolls is limited. It is also desirable to use smooth bags to form a smooth roll. Preferably the length of the overlapping section is larger than half the circumference of the roll, otherwise the subsequent bag will tend to stay within the box 46. The length of a bag should preferably be larger than the circumference of the roll, so as to keep the roll together.

At least during the use the box 46 has to be formed with an opening 47, the length and width thereof chosen to prevent a small roll from leaving the box 46 if a bag is pulled out quickly. This may otherwise happen at the end of a roll. However, at that stage the each bag forms several turns around the roll which will make it more difficult to pull out the bag. Preferably the opening 47 is shaped to facilitate the catch hold of a bag.

What is claimed is:

1. A method of producing plastic bags from a flattened flexible hose (10) including the steps of feeding the hose (10) in a longitudinal direction at a first speed, separating the hose (10) into bags (13) and feeding the bags (13) in a first line of bags, transferring bags of said first line of bags (13) to a second line (14,18) of bags, arranging bags (13) in said second line (14,18) of bags partly overlapping in the longitudinal direction of the second line (14,18) of bags, folding at least one longitudinally extending side edge (15,16) of said second line (14,18) of bags, and winding said second line (14,18) of bags to form rolls (17) of bags.

2. A method according to claim 1, including the step of feeding said second line (14, 18) of bags at a speed lower than said first speed.

3. A method according to claim 1, including the step of directing a first bag to form the centre of the roll (17).

4. A method according to claim 1, including the step of forming bags in first line into wave shape in a plane perpendicular to the plane of the flattened surface of the hose (10) and to the feeding direction of the hose (10).

5. A method according to claim 1, including the steps of splitting up the hose (10) into at least two longitudinally extending sections, repeatedly separating elements (11, 12) from each of said longitudinally extending sections, each element (11, 12) forming a bag, and by directing separated elements (11, 12) forming bags (13) into two lines (14, 18) fed in opposite directions.

6. A method according to claim 5, including the step of winding bags in the lines (14, 18) to form rolls (17) of bags, a first bag forming the centre of the roll (17).

7. A method according to claim 6, including the step of disposing each successive bag to overlap on the outside the previous bag in the roll (17).

8. A method according to claim 6, including the step of disposing each successive bag on top of a bag (13) previously disposed in each of the lines (14,18).

9. A method according to claim 5, including the step of folding in longitudinally extending side edges (15, 16) of bags in said lines (14, 18) before winding lines (14, 18) into the rolls (17).

10. A method according to claim 1, also including the steps of a) feeding each line (14) by a first suction conveyor (27; 28) over a plate (39), b) folding longitudinally extending opposite side edges of the line (14) down from the first suction conveyor (27; 28) by a first set of rollers (32), c) folding in said side edges towards the centre of the line (14) below the plate (39) by a second set of rollers (33), and d) pressing said side edges towards the underside of the plate (39) by a third set of rollers (34).

11. A method according to claim 10, including the step of rotating first, second and third sets (32, 33, 34) of rollers at a speed higher than the feeding speed of the first suction conveyor (27; 28).

12. A method according to claim 1, characterised by rotating heating means (23) around an axis extending transverse to the feeding direction of the hose (10), the circumferential speed of the heating means (23) corresponding to the feeding speed of the hose (10), so as to allow the heating means (23) to accompany the hose during a predetermined period of time, and by cutting, during said period of time, the hose (10) into said sections and sealing side edges of said sections to form the bags.

13. A device for producing plastic bags from a flattened flexible hose (10) including first conveyer (22) for feeding the hose (10), and means for separating hose (10) into bags running in a first line, characterised in that at least a second conveyer (29,30) is provided for feeding the bags in a feeding direction of a second line (14,18), that means (25,26) are arranged for transferring the bags from said first conveyer (22) to said second conveyer (29,30), so that the bags are overlapping in the feeding direction of the second line (14,18) and extending in a first plane, that means (32,33,34) are arranged for folding second line (14,18) transverse to said feeding direction of the second line (14,18), and that means (35) are arranged for winding second line (14,18) into rolls (17) of bags.

14. A device according to claim 13, wherein the heating means (23) comprises at least one heating element extending over the width of the flattened hose (10), and the heating element of said heating means (23) is designed to engage the hose (10) for cutting and sealing.

15. A device according to claim 13, wherein first suction conveyers (27,28) are provided to engage bags of said second lines (14,18), a plate (39) is provided below said first suction conveyers (27,28), a first set of rollers (32) is provided for folding longitudinally extending opposite side edges of the line (14) down from first suction conveyers (27,28), a second set of rollers (33) is provided for folding in said side edges towards the centre of the line (14) below the plate (39), and a third set of rollers (34) is provided for pressing said side edges towards the underside of the plate (39).

16. A device according to claim 13, wherein said means (25,26) for transferring the bags from said first conveyer (22) to said second conveyer (29,30) are formed to fold bags in said first line into wave shape in a plane perpendicular to the plane of the feeding direction of the second line (14,18).

17. A device according to claim 15, wherein a first cutting means (19) is provided to cut the hose (10) into at least two longitudinally extending sections, second cutting and sealing means (23) are provided to rotate around an axis extending transverse to the feeding direction of the hose (10), the circumferential speed of the cutting and sealing means (23) corresponding to the feeding speed of the hose (10) at least during a predetermined period of time, so as to allow the cutting and sealing means (23) to accompany the hose during said predetermined period of time, and to cut, during said period of time, the hose (10) into said sections and seal side edges of said sections to form the bags.

18. A device according to claim 16, wherein the first conveyer (22) is provided for feeding the hose (10) in a substantially horizontal plane at a first horizontal level, and said at least second conveyer (29, 30) extends in a substantially horizontal plane at a second lower horizontal level.

19. A device according to claim 16, wherein a third conveyer (30) is arranged to feed bags in an opposite direction from the feeding direction of the second conveyer (29).

20. A method of producing plastic bags from a flattened flexible hose (10) including the steps of feeding the hose (10) in a longitudinal direction at a first speed, separating the hose (10) into bags (13) and feeding the bags (13) in a first line, transferring bags of said first line of bags (13) to a second line (14,18) of bags, arranging bags (13) in said second line (14,18) partly overlapping in the longitudinal direction of line (14,18), folding at least one longitudinally extending side edge (15,16) of said lines (14,18), winding said lines (14,18) to form rolls (17) of bags and disposing the rolls one by one into a box having an opening for pulling out bags.

21. A device for producing plastic bags from a flattened flexible hose (10) including first conveyer (22) for feeding the hose (10), and means for separating hose (10) into bags running in a first line, wherein at least a second conveyer (29,30) is provided for feeding the bags in a feeding direction of a second line (14,18), means (25,26) are arranged for transferring the bags from said first conveyer (22) to said second conveyer (29, 30), so that the bags are overlapping in the feeding direction of the second line (14,18) and extending in a first plane, means (32,33,34) are arranged for folding second line (14,18) transverse to said feeding direction of the second line (14,18), means (35) are arranged for winding second line (14,18) into rolls (17) of bags, first suction conveyers (27,28) are provided to engage bags of said second lines (14,18), a plate (39) is provided below said first suction conveyers (27,28), a first set of rollers (32) is provided for folding longitudinally extending opposite side edges of the line (14) down from first suction conveyers (27,28), a second set of rollers (33) is provided for folding in said side edges towards the centre of the line (14) below the plate (39), and a third set of rollers (34) is provided for pressing said side edges towards the underside of the plate (39).

22. A method of producing bags from a flattened flexible hose (10) including the steps of feeding the hose (10) in a longitudinal direction at a first speed, separating the hose (10) in a manner to form a pair of bags (13) and feeding the pair of bags (13) in a first line, transferring bags of said first line of bags (13) to a second line (14) of bags operable at a second speed, arranging bags (13) in said second line (14) of bags partly overlapping in the longitudinal direction of the second line (14) of bags, folding at least one longitudinally extending side edge (15, 16) of said second line (14) of bags, and winding said second line (14) of bags to form rolls (17) of bags.

23. A method of producing a roll of separated overlapping bags comprising feeding a flattened flexible hose in one longitudinal direction, longitudinally separating the flattened flexible hose into two longitudinally extending sections, transversely separating and sealing the longitudinally extending sections to form opposing separated open top bags, feeding the separated bags formed from at least one of the two longitudinally extending sections in another longitudinal direction, overlapping at least some of the separated bags being fed, longitudinally folding the overlapped separated bags being fed in the other longitudinal direction, and rolling the overlapped and folded bags into a roll whereby the separated bags can be withdrawn from the roll at least one at a time.

* * * * *